US009863209B2

(12) United States Patent
Strickland

(10) Patent No.: US 9,863,209 B2
(45) Date of Patent: Jan. 9, 2018

(54) GAS LIFT MANDREL AND ISOLATOR

(71) Applicant: PCS FERGUSON, INC., Frederick, CO (US)

(72) Inventor: Derrick Eugene Strickland, Erie, CO (US)

(73) Assignee: PCS FERGUSON, INC., Frederick, CO (US)

( * ) Notice: Subject to any disclaimer, the term of this patent is extended or adjusted under 35 U.S.C. 154(b) by 246 days.

(21) Appl. No.: 14/844,997

(22) Filed: Sep. 3, 2015

(65) Prior Publication Data

US 2016/0069152 A1 Mar. 10, 2016

Related U.S. Application Data

(60) Provisional application No. 62/046,641, filed on Sep. 5, 2014.

(51) Int. Cl.

| | |
|---|---|
| ***E21B 33/128*** | (2006.01) |
| ***E21B 34/14*** | (2006.01) |
| ***E21B 23/03*** | (2006.01) |
| ***E21B 43/12*** | (2006.01) |

(52) U.S. Cl.

CPC ..... *E21B 33/128* (2013.01); *E21B 23/03* (2013.01); *E21B 34/14* (2013.01); *E21B 43/122* (2013.01)

(58) Field of Classification Search

CPC ..... E21B 23/03; E21B 33/128; E21B 34/14; E21B 43/122; E21B 43/123

See application file for complete search history.

(56) References Cited

U.S. PATENT DOCUMENTS

| | | | | |
|---|---|---|---|---|
| 1,926,030 | A * | 9/1933 | Boynton | E21B 43/122 137/155 |
| 2,680,408 | A * | 6/1954 | Davis | E21B 43/122 166/53 |
| 3,059,700 | A * | 10/1962 | Lindsey | E21B 23/03 166/332.5 |
| 3,185,219 | A * | 5/1965 | Grimmer | E21B 23/02 166/215 |
| 3,799,259 | A | 3/1974 | Dinning | |
| 2005/0061369 | A1 * | 3/2005 | De Almeida | E21B 23/03 137/155 |

* cited by examiner

*Primary Examiner* — James G Sayre

(74) *Attorney, Agent, or Firm* — Russell T. Manning; Marsch Fischmann & Breyfogle LLP

(57) ABSTRACT

An isolation tool is presented for use in fluidly isolating first and second sections of tubing and more typically to a bleed valve/port of a gas lift mandrel. The isolation tool is configured for disposition within an interior of a gas lift mandrel. The isolation tool includes one or more resilient elements that may be compressed to expand to and seal against an inside surface of the tubing/mandrel. Such expansion and sealing by the resilient element(s) fluidly isolates sections of the tubing/mandrel. The isolation tool may be removed through the tubing when desired by releasing the compression of the resilient element(s) such that the resilient element(s) disengage the inside surface of the tubing/mandrel.

19 Claims, 15 Drawing Sheets

GAS LIFT MANDREL AND ISOLATOR

CROSS REFERENCE

The present application claims the benefit of U.S. Provisional Application No. 62/046,641 having a filing date of Sep. 5, 2014, the entire contents of which is incorporated herein by reference.

FIELD OF THE INVENTION

The present invention relates to gas lift systems that inject gas into production tubing of hydrocarbon production wells. More specifically, a gas lift mandrel and removable isolation tool is disclosed that allows for isolating gas injection ports of the gas lift mandrel during installation of a string of production tubing into a well casing.

BACKGROUND

Well bores of oil and gas wells extend from the surface to permeable subterranean formations ('reservoirs') containing hydrocarbons. These well bores are drilled in the ground to a desired depth and may include horizontal sections as well as vertical sections. In any arrangement, piping (e.g., steel), known as casing, is inserted into the well bore. The casing may have differing diameters at different intervals within the well bore and these various intervals of casing may be cemented in-place. Other portions (e.g., within producing formations) may not be cemented in place and/or include perforations to allow hydrocarbons to enter into the casing. Alternatively, the casing may not extend into the production formation (e.g., open-hole completion).

Disposed within a well casing is a string of production piping/tubing, which has a diameter that is less than the diameter of the well casing. The production tubing may be secured within the well casing via one or more packers, which may provide a seal between the outside of the production piping and the inside of the well casing. The production tubing provides a continuous bore from the production zone to the wellhead through which oil and gas can be produced.

The flow of fluids, from the reservoir(s) to the surface, may be facilitated by the accumulated energy within the reservoir itself, that is, without reliance on an external energy source. In such an arrangement, the well is said to be flowing naturally. When an external source of energy is required to flow fluids to the surface the well is said to produce by a means of artificial lifting. Generally this is achieved by the use of a mechanical device inside the well (e.g., pump) or by decreasing the weight of the hydrostatic column in the production tubing by injecting gas into the liquid some distance down the well.

The injection of gas to decrease the weight of a hydrostatic column is commonly referred to as gas lift, which is artificial lift technique where bubbles of compressed air/gas are injected to reduce the hydrostatic pressure within the production tubing to below a pressure at the inlet of the production tubing. In one gas lift arrangement, high pressure gas is injected into the annular space between the well casing and the production tubing. At one or more predetermined locations along the length of the production tubing, gas lift valves permit the gas in the annular space to enter into the production tubing.

The gas lift valves are supported by gas lift mandrels, which are devices installed in the production tubing onto which or into which the gas-lift valve is fitted. In a conventional gas-lift mandrel, the gas-lift mandrel is a short section of tubing disposed in the production tubing string that supports a gas lift valve disposed on its exterior surface. The gas lift valve controls the flow of pressurized gas from the well casing through a valve port into an interior of the mandrel. Tubing and casing pressures cause the gas-lift valve to open and close, thus allowing gas to be injected into the production tubing causing fluid in the tubing to rise to the surface. Further, different mandrels may have valves with different pressure settings.

Conventional gas-lift mandrels are installed as the production tubing is placed in the well casing. During the placement of the production tubing, the production tubing is commonly filled with fluid such that the production tubing is not buoyant prior to placement of the packer(s). Thus it is necessary to isolate the gas lift valve(s) during production tubing placement to prevent injection of gases in the well casing into the production tubing. Previously, such isolation has entailed the insertion of a frangible sealing disk (e.g., ceramic) at the upper and/or lower joint between the mandrel and the production tubing. Once the production tubing is set within the casing, such frangible seals are removed by, for example, application of pressure and/or lowing of a breaking implement through the interior bore of the production tubing.

One drawback of the use of such frangible seals is that a portion (e.g., peripheral rim portion) can remain within the interior bore of the production tubing. Such remaining portions of the frangible seal may hinder or prevent the insertion of down-hole implements through the production tubing. For instance, such remaining seal portions may prevent passage of a plunger preventing use of plunger assisted gas lift for the well without removal of the entire string of production tubing.

SUMMARY

Presented herein is an isolation tool for use in fluidly isolating first and second sections of tubing. One non-limiting application of the isolation tool is to isolate a bleed valve of a gas lift mandrel. This isolation may be provided during placement of production tubing into a well casing. In this regard, the isolation tool is configured for disposition within tubing, such as a gas lift mandrel. The isolation tool includes one or more resilient elements that may be compressed to expand to and seal against an inside surface of the tubing/mandrel. Such expansion and sealing by the resilient element(s) fluidly isolates sections of the tubing/mandrel. Further, expansion of the resilient element(s) at least partially maintains the isolation tool within the tubing/mandrel. However, the isolation tool may be removed through the tubing when desired. In this regard, the compression of the resilient element(s) may be released such that the resilient element(s) disengage the inside surface of the tubing/mandrel to allow removal of the tool through the interior bore of the tubing/mandrel.

In one aspect, the isolation tool includes a stem having an upper end and lower elongated rod. The transition between the upper end of the stem and lower elongated rod defines an annular flange having a cross-dimension that is greater than a cross-dimension of the elongated rod. One or more annular resilient elements is disposed along the length of the rod. A releasable connector having at least one sleeve is disposed on the elongated rod below the resilient element(s). The sleeve of the releasable connector is adapted to compress against a lower end of the resilient element(s) in order to expand the periphery of the resilient element outward. That is, the sleeve of a releasable connector compresses the resilient element against the annular flange of the stem. However, it will be appreciated that various spacers may be disposed between the annular flange and resilient element(s) and/or between the sleeve of the releasable connector and the resilient element(s). The releasable connector is adapted to fixedly engage the elongated rod of stem while the resilient element(s) is compressed. In this regard, the releasable connector maintains compression and expansion of the resilient element when connected to the elongated rod. The releasable connector is further adapted to release the elongated rod in response to an axial force being applied to the stem/elongated rod. That is, while the resilient element(s) is expanded, this element prevents upward movement of the releasable connector. By applying an upward axial force along the stem, the rod moves relative to the releasable connector and releases the releasable connector, which removes compressive force applied to the resilient element thereby allowing the resilient element to relax. Accordingly, the tool may then be removed from the tubing/mandrel.

In one arrangement, the releasable connector has a connection element that attaches to a mating connection element disposed on the elongated rod at a location below the resilient element(s). That is, the rod and releasable connector may have mating connecting elements. In various arrangements, these mating connection elements may include, for example, a spring ball or snap ring in either the releasable connector or on the stem that engages a mating detent or groove on the other of the releasable connector or stem. In another arrangement a ratcheting connector may be used. In a further arrangement, the rod of the stem and sleeve of the releasable connector each include a sheer pin aperture. In such an arrangement, the sleeve may be advanced along the rod until the sheer pin apertures align. When sheer pin apertures align, the resilient element(s) may be compressed. At this time, the sheer pin may be disposed within the sheer pin aperture to maintain compression of the resilient element(s). Accordingly, when an axial force is applied to the stem, the sheer pin may sheer thereby releasing the sleeve of the releasable connector and releasing compression of the resilient element(s).

The lower end of the elongated rod may extend through the sleeve of the releasable connector. A retention element may be attached to the lower end of the elongated rod to prevent sleeve and or resilient element(s) from falling off of the elongated rod upon compression release. Further, the lower end of the elongated rod may be utilized to apply a compressive force to the resilient element(s). In one arrangement, when placed in the tubing/mandrel (e.g., prior to attachment to production tubing), the rod may be grasped by hydraulic actuator to advance the sleeve and compress the resilient element(s). In another arrangement, the lower end of the rod may be threaded to allow use of a threaded element (e.g., nut) to compress the resilient element(s).

In a further arrangement, the lower end of the tool has a collapsible retention device that allows for mechanically affixing the tool within a joint between the tube/mandrel housing the tool and a second adjacent tube. In one arrangement, the collapsible retention device is part of the releasable connector. In such an arrangement, the sleeve of the releasable connection element has a lower colleted end. When expanded, the lower colleted end has a diameter that is greater than the inside diameter of the tubing/mandrel and adjacent tube. In such an arrangement, the lower colleted end may expand into the spacing between tubes, which are typically connected by a larger diameter collar thereby mechanically fixing the tool within the mandrel. When the resilient element is released, the axial force applied the stem may allow collapsing the colleted end into the interior of the tubing/mandrel and thereby permit removal of the tool through the tubing. In a further arrangement, the releasable connector utilizes an inner sleeve and outer sleeve. In this arrangement the outer sleeve may include the colleted end and the inner sleeve may be movable between a first position that prevents the colleted end from collapsing and a second position that allows the colleted end to collapse.

In a further arrangement, the tool may include a fluid equalization assembly that selectively allows fluid to bypass across the tool. In this regard, the fluid equalization assembly may include a fluid path that extends through the stem from a first port located proximate the top end of the stem through at least a portion the elongated rod to a second port that exits the elongated rod at a location below the resilient element(s). To maintain fluid isolation, when desired, the fluid equalization assembly may include a valve. This valve may move between an open position to permit fluid flow through the flow path and a closed position to prevent fluid flow through the flow path. In one arrangement, a poppet rod connected to a biased plunger extends through the top surface of the stem. The poppet rod may be depressed from the surface to displace the plunger and thereby permit fluid flow through the flow path.

DETAILED DESCRIPTION

Reference will now be made to the accompanying drawings, which at least assist in illustrating the various pertinent features of the presented inventions. The following description is presented for purposes of illustration and description and is not intended to limit the inventions to the forms disclosed herein. Consequently, variations and modifications commensurate with the following teachings, and skill and knowledge of the relevant art, are within the scope of the presented inventions. The embodiments described herein are further intended to explain the best modes known of practicing the inventions and to enable others skilled in the art to utilize the inventions in such, or other embodiments and with various modifications required by the particular application(s) or use(s) of the presented inventions.

The following disclosure is directed to an isolation tool that may be inserted into a gas lift mandrel in conjunction with placing of production tubing within a well casing. Generally, embodiments of the isolation tool utilize one or more packers or resilient elements to seal off sections of the production tubing, which is fluid filled during placement in the well casing. More specifically, the resilient elements seal off valve or bleed ports of the gas lift mandrels to prevent fluid within the production tubing form bleeding out of the tubing and/or to prevent infiltration of gas/fluid into the production tubing. Two exemplary embodiments are set forth in the present disclosure. Specifically, in a first embodiment the isolation tool utilizes at least two resilient elements and in a second embodiment the isolation tool utilizes a single resilient element. However, it will be appreciated that the present disclosure is not limited to the presented embodiments and variations to the presented embodiments are considered within the scope of the present disclosure.

Figure 1:
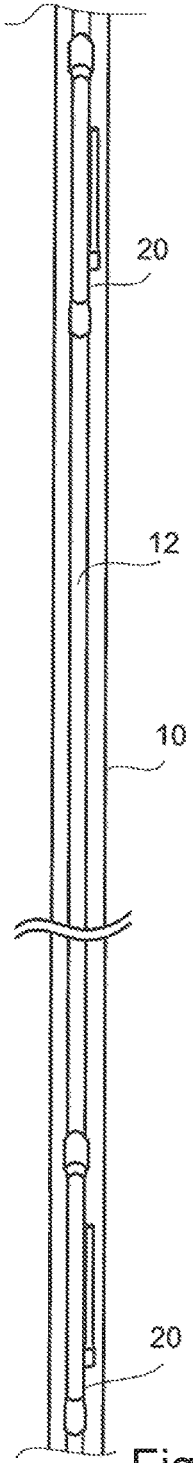
Fig. 1 (Prior Art)
FIG. 1 is a schematic illustration of a production tubing is disposed within a casing of an oil and gas well.
Figure 2:
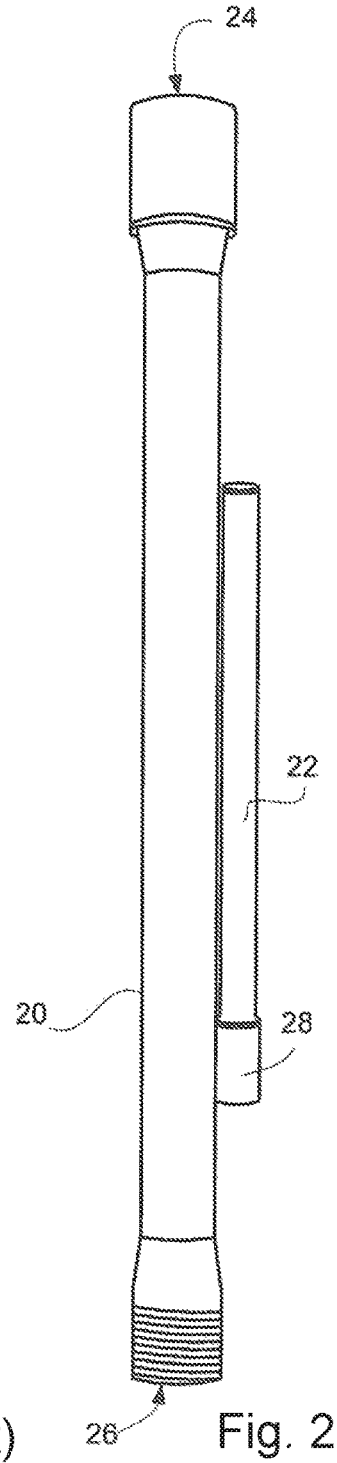
Fig. 2 (Prior Art)
FIG. 2 is a plan view of a gas lift mandrel.
Figure 3:
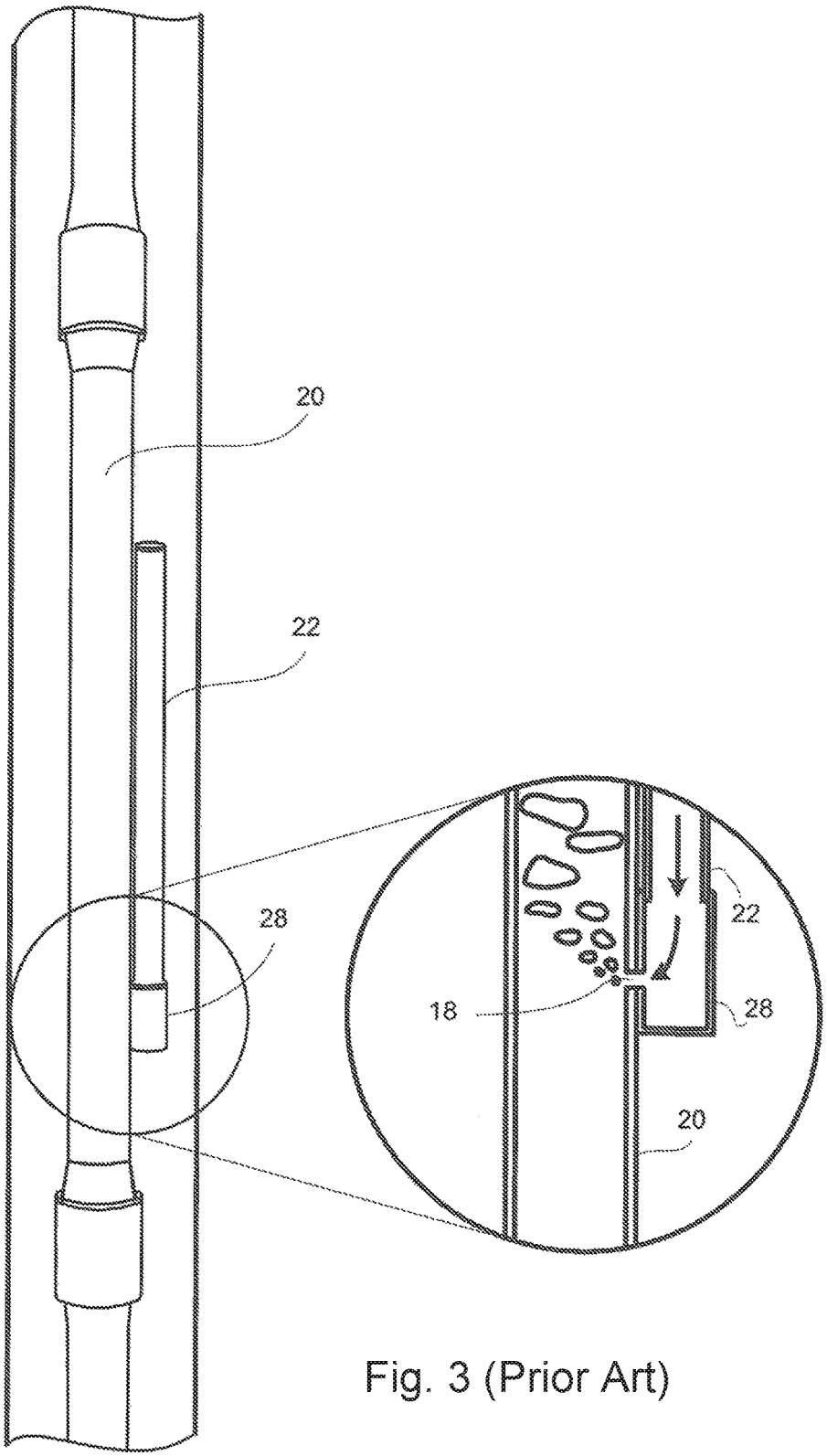
Fig. 3 (Prior Art)
FIG. 3 is a schematic illustration of injection of gas into a production tubing.

FIG. 1 is a schematic illustration of an exemplary installation of a conventional gas lift arrangement. As illustrated, a string of production tubing 12 is disposed within a casing 10 of an oil and gas well. Disposed along the production string 12 at predetermined subterranean locations are one or more mandrels 20. Each of these mandrels 20 supports a gas lift valve 22, which is operative to open and close based on pre-set pressure settings. As shown in FIG. 2, each mandrel 20 is tubular member having first and second open-ends 24, 26 that are adapted for in-line connection with the production tubing 12. In this regard, one or both ends may be threaded and/or include a collar. The mandrel 20 further includes a lug 28 on its outside surface that supports the gas lift valve 22. The lug includes one or more internal valve ports/bleed ports 18 that communicate with the interior of the mandrel. See FIG. 3. The gas lift valve 22 may be any appropriately configured gas lift valve and may include various check valves. Typically, such gas lift valves include internally pressurized bellows that allow the valve to open and close based on predetermined pressure changes. For instance, such valves may normally be closed and only open after a gas lift pressure overcomes a downward force of the charged bellows. Exemplary valves that may be utilized are available from PCS Ferguson, Inc. of 3771 Eureka Way, Frederick, Colo. 80516.

In operation, a high-pressure source of gas (not shown) is injected down through the well casing in the annulus between the well-casing 10 and the production tubing 12. The gas lift valves 22 supported by each mandrel 20 opens as the injection gas displaces fluid from the annulus. As these valves open, the opened valve injects gas from the annulus into production tubing 12 via valve port(s) 18 in the mandrel 20. See FIG. 3. In some arrangements, upper gas valves may close after lower gas valves open. In any arrangement, as the injected gas flows to the surfaces it expands thereby lifting the liquid within the production tubing and reducing the density and column weight of the fluid in the tubing.

It is common to fill the interior of the production tubing and mandrels with fluid when the mandrels 20 and the production tubing 12 are inserted into the casing 10. To prevent fluid from exiting the production tubing and/or gas from the casing entering into the production tubing, it is desirable to isolate the valve ports 18 during the insertion process. Provided herein are various embodiments of isolation tools that allow for isolating the valve ports 18 of the mandrels 20 such that no fluid may flow into or out of the mandrels during installation of the production tubing. Further, the isolation tools allow for subsequent retrieval and removal through the bore of the production tubing such that no debris remains within the production tubing.

Figure 4A:
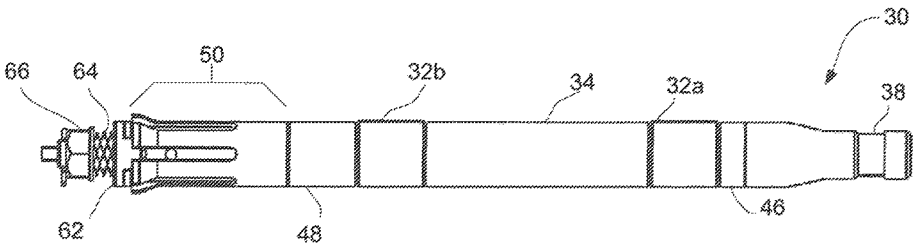
FIG. 4A is a side view of a first embodiment of a gas lift mandrel isolation tool.
Figure 4B:
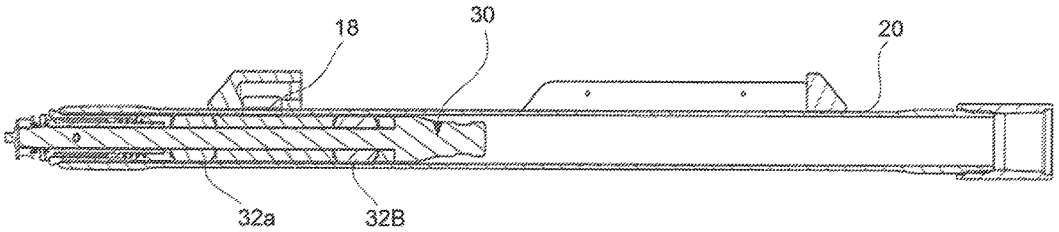
FIG. 4B illustrates insertion of the isolation tool in a gas lift mandrel.
Figure 4E:
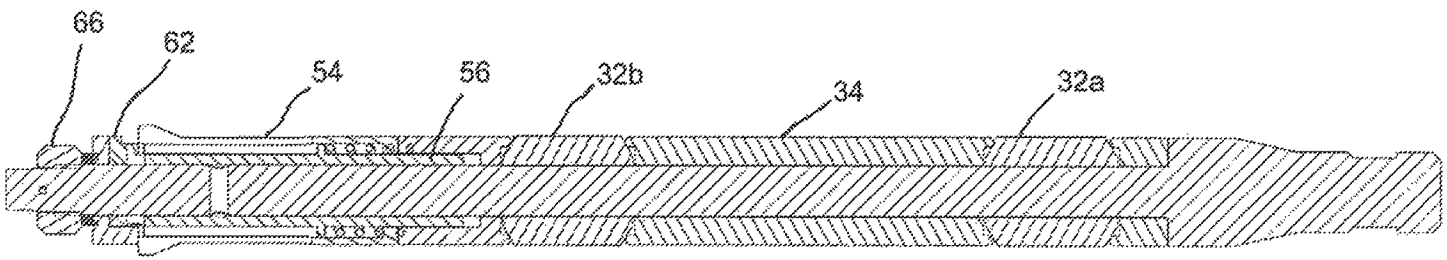
FIG. 4E illustrates the isolation tool in the gas lift mandrel after compression is released.
Figure 4D:
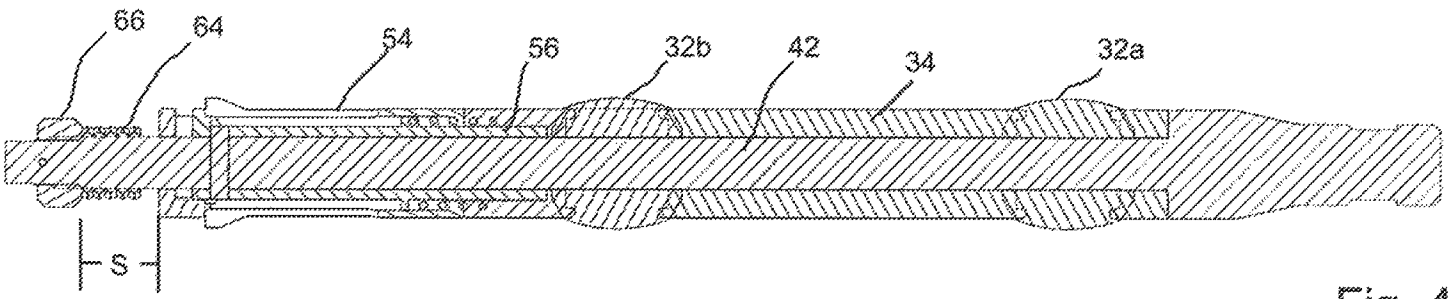
FIG. 4D illustrates the isolation tool in a locked compressed state.
Figure 4C:
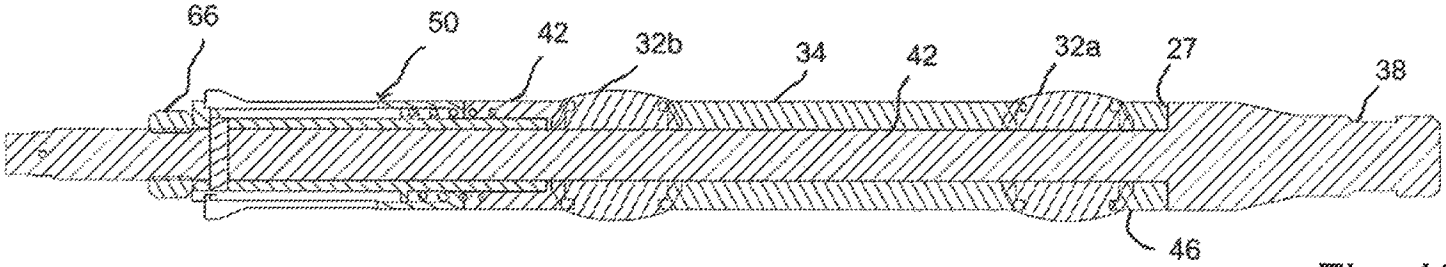
FIG. 4C illustrates the isolation tool as compressed within the gas lift mandrel.

FIG. 4A-4E illustrate one embodiment of an isolation tool 30 that may be utilized to isolate a valve port 18 of a mandrel 20 during the installation process. As shown, the first embodiment of the isolation tool 30 includes first and second resilient elements 32*a* and 32*b* (hereinafter "32" unless specifically referenced) that are separated by a non-compressible spacer sleeve 34. The resilient elements may be any appropriate material that compresses axially and expands outward in response to an applied compression and which substantially returns to its original shape once the compression is removed. In the present embodiment, the tool 30 is placed within the interior bore of the mandrel 20 such that the spacer sleeve 34 between the resilient elements 32 is positioned proximate to the valve port 18 within the mandrel 20. See FIG. 4B. Stated otherwise, the resilient elements 32 are disposed on either side of the valve port(s) 18. The tool 30 is then compressed such that the resilient elements 32 expand outward and engage the inside surface of the mandrel 20. Expansion of the resilient elements is illustrated in FIGS. 4C and 4D, where the mandrel is not illustrated for purposes or clarity. At such time, the resilient elements 32 engage the inside surface of the mandrel about their peripheries and fluidly isolate the valve port from the interior of the mandrel and, hence, the production tubing.

After the production tubing is in positioned within the well casing, the isolation tool 30 may be retrieved from the mandrel. More specifically, the compression of the resilient elements is relaxed such that isolation tool may be retrieved through the interior of the production tubing. For instance a coiled tubing, slickline, or sand line may be disposed through the interior of the production tubing to engage a fishing neck 38 disposed on the top end of the tool 30. As utilized herein top end and bottom end refer to the orientation of the tool as disposed within a well. That is, "top" refers to items that are up in the well bore and "bottom" refers to items that are down in the well bore. However, such nomenclature utilize only for purposes of discussion and not by way of limitation. In any arrangement, the fishing neck 38 may be engaged by an element (e.g., retrieval line) disposed through the interior bore of the production tubing. Once the retrieval line engages the fishing neck 38, an upward force may be applied to the isolation tool 30. As is further discussed herein, this upward force allows for disconnecting a releasable compression device or releasable connector that maintains the compressive force, which expands the first and second resilient elements 32. Once the releasable connector disconnects, the compressive force is removed, the resilient elements relax and the tool disengages from the interior surface of the mandrel. See FIG. 4E. At this time, the isolation tool 30 may be retrieved through the interior of the mandrel and the production tubing string.

Figure 5A:
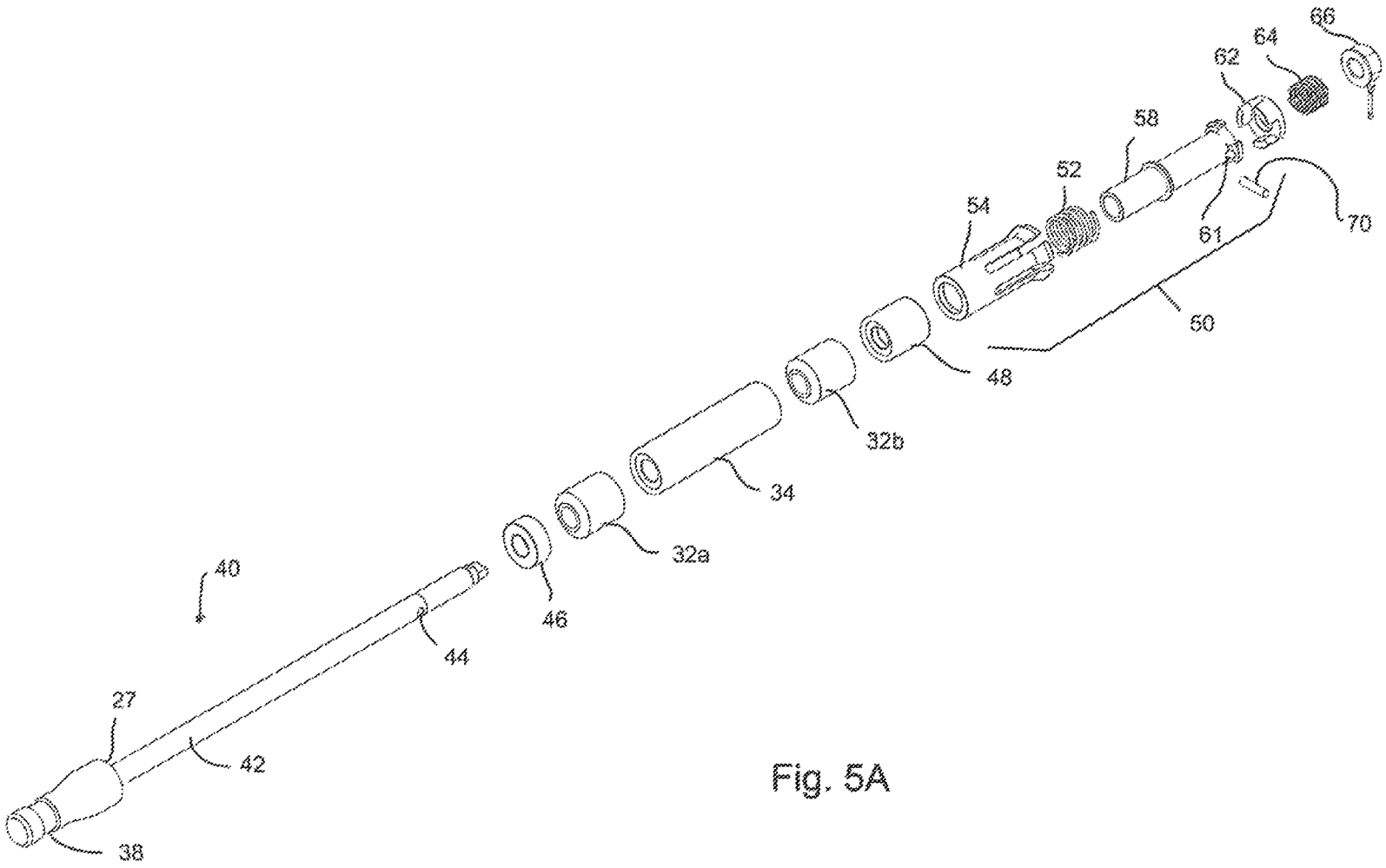
FIG. 5A is an exploded perspective view of the isolation tool of FIG. 4A.

FIG. 5A illustrates an exploded perspective view of the first embodiment of the isolation tool 30. As shown, the isolation tool 30 includes a central stem 40 that supports a plurality of substantially non-compressible ring or sleeve members (e.g., metallic elements), the compressible first and second resilient elements 32*a*, 32*b* and a releasable connector assembly 50. All of the ring members, sleeve members and resilient elements include a central bore that that allows these members to slide over the stem.

Figure 5B:
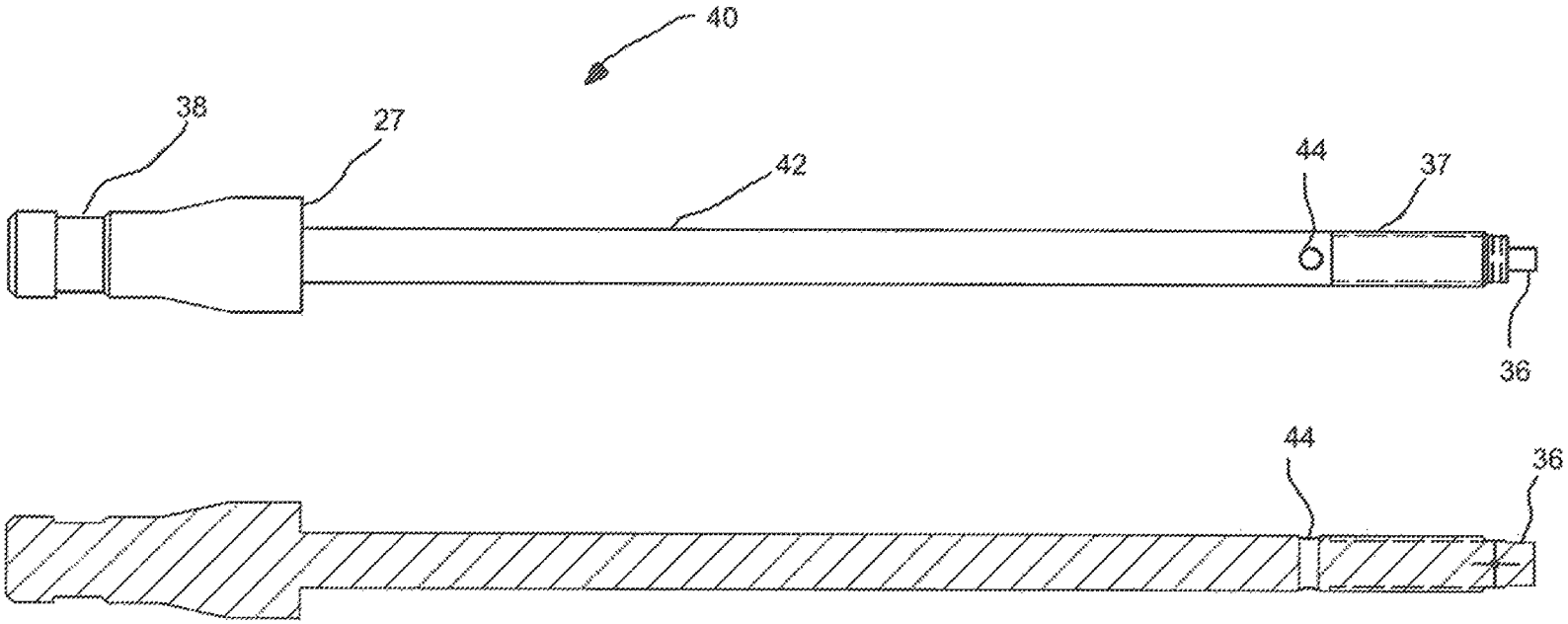
FIG. 5B is a plan and cross-sectional view of the stem of the isolation tool.

As shown in FIG. 5B, the stem 40 includes the fishing neck 38, which forms its upper portion, and a lower rod member 42. In use, the resilient elements are disposed over the rod and compressed when the tool is inserted into a mandrel/tubing. The releasable connector assembly 50 is disposed below the resilient elements and is configured to releasably connect to the rod once the resilient elements are compressed. When the tool is ready for removal, the releasable connector releases the rod and allows the resilient elements to relax. A number of releasable connectors may be utilized to engage the rod member once the resilient elements are compressed. For instance, a spring ball supported in a lower sleeve may engage a groove in a lower end of the rod. Alternatively, a latching ratchet associated with a lower sleeve may engage a pawl on the lower end of the rod or vice versa. In the latter arrangement, the stem could be jarred to release the ratchet. In the presented embodiment, the releasable connector is illustrated as a shear pin that extends through a lower sleeve and the rod member. However, it will be appreciated that other releasable connecting devices are possible and within the scope of the present disclosure.

In the illustrated embodiment, a first shear pin aperture 44 extends through a lower end of the rod member 42 transverse to its long axis. Below the shear pin aperture 44 is a length of threads (not shown) that allow use of a threaded nut 66 to load/compress the resilient elements and connect the releasable connector to the rod to maintain compression of the resilient elements. However, it will be appreciated that other method of loading/compressing the resilient elements are possible. For instance, a hydraulic cylinder press sliding over and grasping the lower end of the stem may be utilized to compress the resilient elements. The lower end of the rod member may also include a cotter pin aperture (not shown) that may be utilized to retain the nut and other elements on the lower end of the rod member (e.g., once the releasable connector releases the rod). The stem also includes an annular compression flange 27 formed at the transition between the rod member 42 and the upper fishing neck. This annular compression flange 27 provides a surface against which the resilient elements are compressed.

Figure 5C:
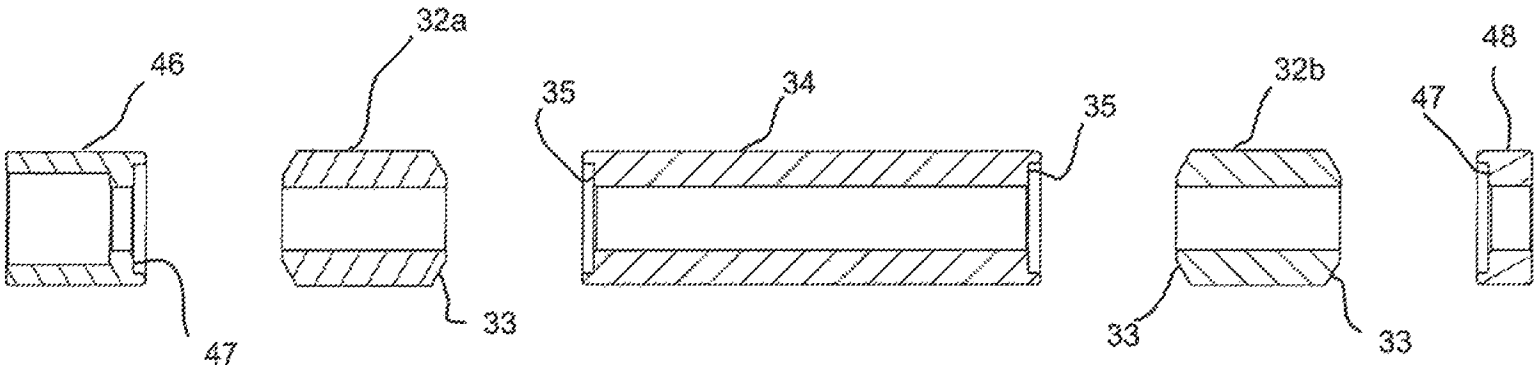
FIG. 5C is a cross-sectional view of spacers and resilient elements of the isolation tool.

As shown in FIGS. 5A and 5C, an annular spacer ring 46 is inserted on the rod 42 of the stem 40 such that an upper surface of the ring 46 abuts the annular compression flange 27. The lower surface of the spacer ring 46 abuts against the upper surface of the upper resilient element 32*a*. In the present embodiment, the lower surface of the spacer ring 46 is a recessed surface 47 that receives a semi-conical upper surface 33 of the resilient element 32*a*. The spacer ring 46 is provided to facilitate manufacture of a surface that conforms to the adjacent resilient element. However, it will be appreciated that the annular compression flange 27 of the stem 40 may be likewise configured with a recessed surface. In such an arrangement, the spacer ring 46 may be omitted.

The first annular resilient element 32*a* is inserted over the rod 42 below the spacer ring 46 such that its upper semi-conical surface 33 (when utilized) is received in the recess 47 of the spacer ring 46. Below the first resilient packer 32*a* is the spacer sleeve 34. The spacer sleeve 34 is generally a non-resilient element (e.g., steel) that is substantially incompressible relative to the resilient elements 32*a*, 32*b*. In the illustrated embodiment, both ends of the spacer sleeve 34 are recessed surfaces 35 configured to engage/receive semi-conical ends 33 of the first and second resilient elements 32*a*, 32*b*. The second annular resilient element 32*b* is disposed on the rod 42 after the spacer sleeve 34. In the present embodiment, a second annular spacer ring 48 is inserted against the second resilient element 32*b*. The second spacer ring 48 also includes a recessed surface 47 configured to engage the bottom end of the second resilient element 32*b*.

The releasable connector assembly 50 is disposed on the stem below the second spacer ring 48. See FIG. 5A. The releasable connector assembly 50 includes an annular outer sleeve 54, an annular inner sleeve 58 and a biasing spring 52. In the present embodiment, the inner sleeve 58 includes a second shear pin aperture 61. As will be further discussed herein, when the second shear pin aperture 61 is aligned with first shear pin aperture 44 of the stem 40, the first and second resilient sleeve members 32*a*, 32*b* are compressed such that they expand outward to engage the inside surface of a mandrel. Also disposed on the stem 40 beneath the releasable connector assembly 50 is a standoff 62, a spring 64, and a threaded nut 66 which, in the present embodiment, engages threads 37 on the lower end of the rod. See FIG. 5B. In this embodiment, the terminal end of the rod also includes a tab 36 that may be engaged (e.g., by a wrench) when the threaded nut 66 is being threading onto the threads 38.

The threaded nut 66 serves multiple functions for the illustrated embedment of the tool 30. Initially, the threaded nut 66 may be threaded onto the threads 38 to compress the lower sleeve assembly 50 against the resilient elements 32*a*, 32*b*. See FIG. 4C. That is, the spacer rings, spacers 46, 48 sleeve 34 and resilient elements 32*a*, 32*b* may be compressed against the annular flange 27. More specifically, as the retention nut 66 advances along the threads, it contacts the lower end of the lower sleeve assembly 50 and compresses the resilient elements 32*a*, 32*b*, which expand outward to contact the interior of the mandrel and inward to contact the stem. The retention nut 66 may be threaded onto the threads until the second shear pin aperture 61 in the inner sleeve of the releasable connector assembly 50 is aligned with first shear pin aperture of the rod member 42. At this time, a shear pin 70 may be inserted through the aligned shear pin apertures. The shear pin 70 then maintains the compression of the first and second resilient elements 32*a*, 32*b*. That is, once the shear pin 70 is inserted, the threaded nut 66 is not required to maintain the compression of the resilient elements 32. See FIG. 4C.

As the threaded nut 66 is not required to maintain compression, it may be backed off of the lower end of the lower sleeve assembly 50. However, it is desirable that the threaded nut 66 remain on the rod member 42. That is, once the shear pin 70 is sheared, if the threaded nut were absent, the spacers, sleeves and resilient elements would otherwise fall off the bottom end of the stem 40. In the present embodiment, the threaded nut 66 is backed off but remains on the threaded end of the rod 42 to prevent the sleeves and resilient elements from falling off the rod 42 upon shearing of the shear pin 70. See FIG. 4D. However, it will be appreciated that other retention elements may be attached to the end of the rod to maintain the sleeves, resilient elements etc. form falling off the tool upon compression release. Furthermore, it will be appreciate that any retention element (e.g., threaded nut 66) must be spaced from the back end of the lower sleeve assembly 50 allow relative movement between the rod 42 and lower sleeve assembly 50 to permit releasing the releasable connector (e.g., shearing of the shear pin 70). In the present embodiment, the threaded nut 66 is backed off to a lower portion of the threads to provide a space 'S' between nut and the lower end of the releasable connector assembly 50. A spring 64 (i.e., annular spring) is disposed between the retention nut 66 and the releasable connector assembly. See FIG. 4D.

When the fishing neck 38 is engaged and an axial force is applied to the stem and rod member 42 (i.e., while the compressed resilient elements engage an insider surface of a mandrel), the rod member 42 moves relative to the releasable connector assembly 50, which is maintained in place by the expanded resilient elements. This movement releases that releasable connector (e.g., shears the shear pin 70) allowing the resilient elements 32*a* and 32*b* to relax. See FIG. 4E. The tool may then be removed from the mandrel.

FIGS. 6A-6F illustrate another embodiment of an isolation tool 130. Like reference numbers are utilized to identify like elements. In contrast to the isolation tool 30 discussed in relation to FIGS. 4A-5C, the isolation tool of FIGS. 6A-6F utilizes a single resilient element 32 to fluidly isolate a first portion of a gas lift mandrel or other tubing from a second portion of the mandrel/tubing. That is, rather than isolating both sides of a gas valve port in a mandrel, the single resilient element isolation tool 130 isolates tubing on one side of the gas valve port. The isolation of the gas valve port on one side (i.e., from an entire column of fluid within the production tubing) in conjunction with a valve (e.g., check valve) within the gas valve attached to the mandrel provides sufficient isolation in most applications.

Figure 6A:
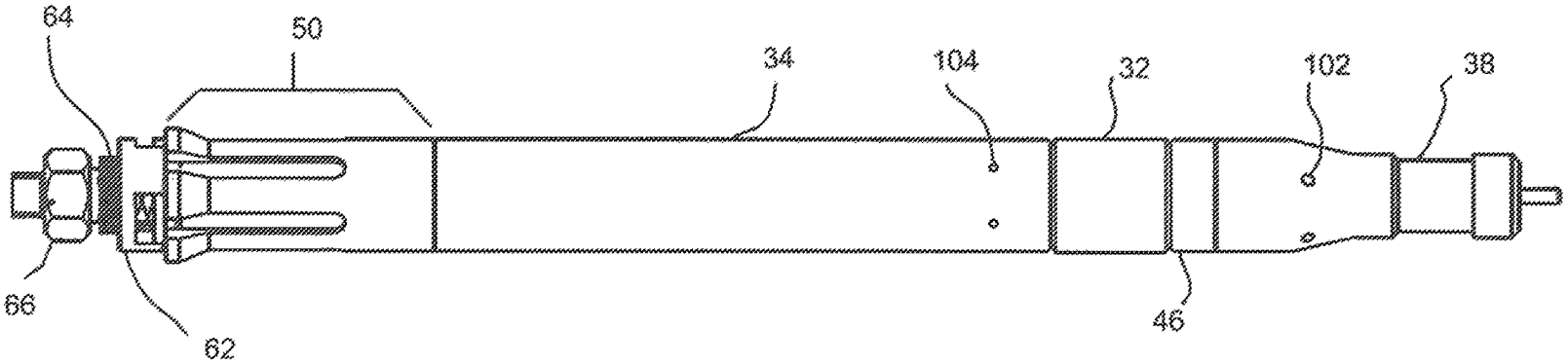
FIG. 6A illustrates a side view of a second embodiment of the isolation tool.
Figure 6B:
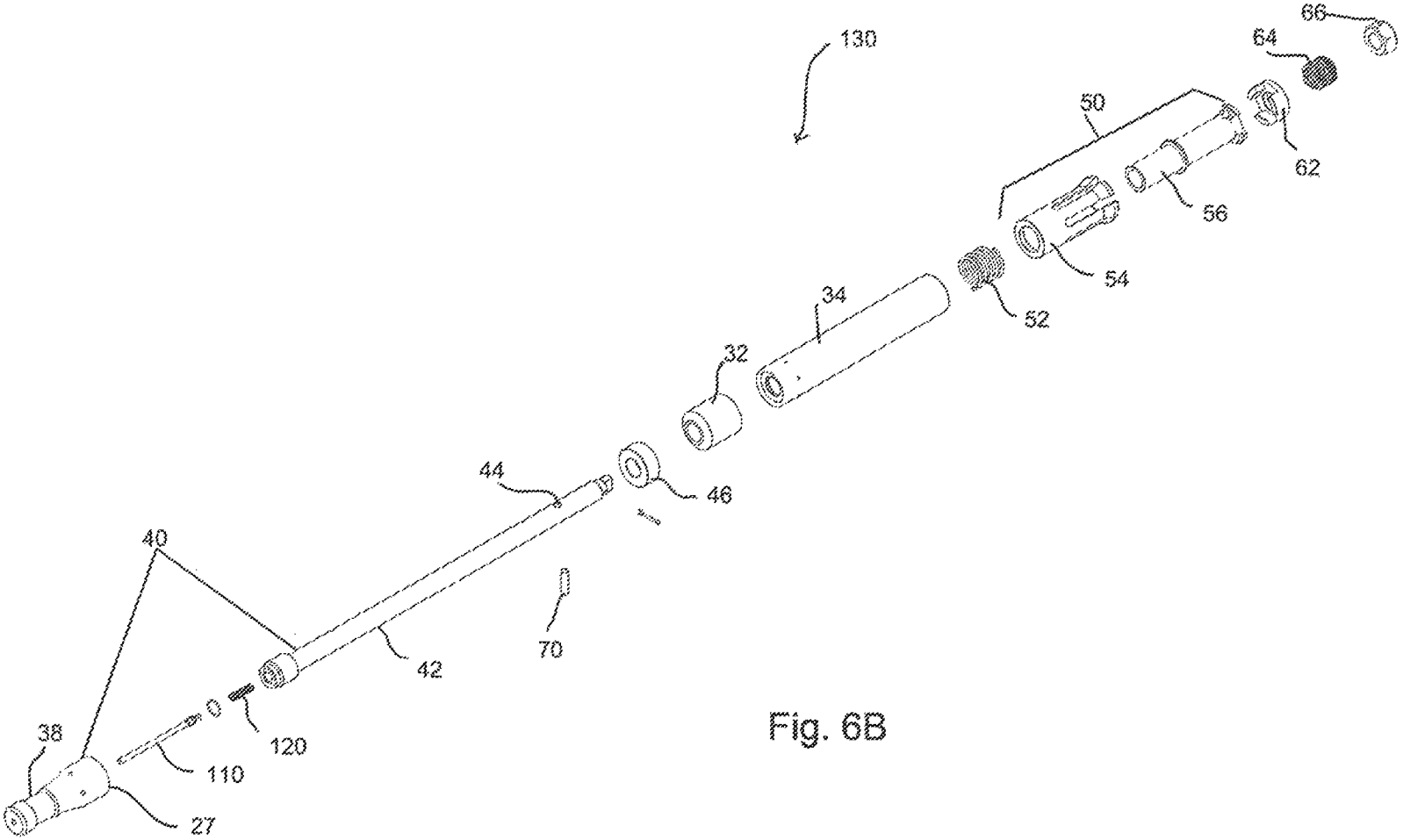
FIG. 6B is an exploded perspective view of the isolation tool of FIG. 6A.
Figure 6C:
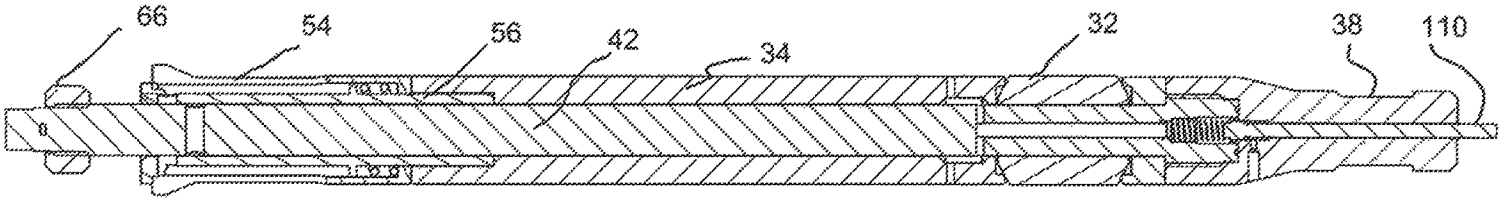
FIGS. 6C-6F illustrate, insertion compression, locked compression and release of the second embodiment of the isolation tool.
Figure 6D:
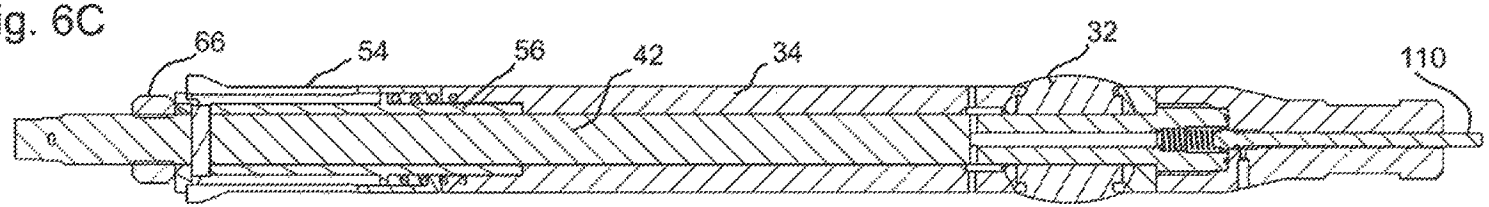
Figure 6E:
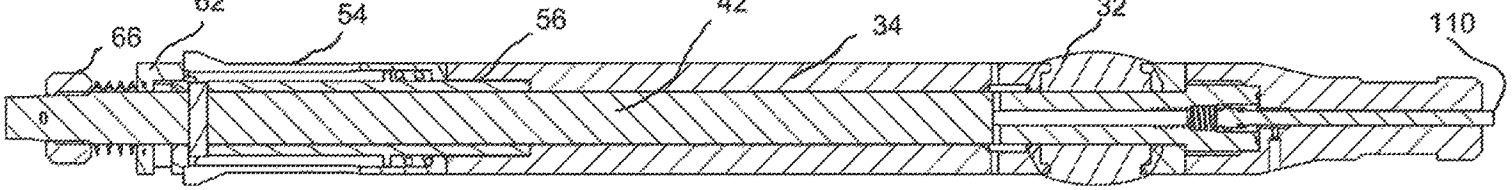
Figure 6F:
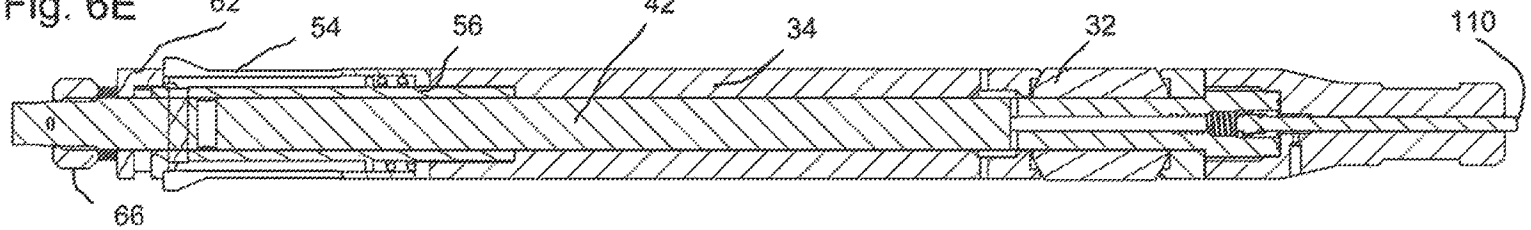

As shown in FIGS. 6A and 6B, the illustrated isolation tool 130 includes a two piece stem 40 made of a fishing neck 38, which forms the upper portion of the stem and a rod member 42, which forms the lower portion of the stem. The rod member is threaded into a lower end of the fishing neck. In the illustrated embodiment, the two piece stem is provided to allow incorporation of pressure/fluid equalization assembly, which is discussed further herein. However, it will be appreciated that in further embodiments, the single resilient isolation tool 130 may utilize a one-piece stem 40. This embodiment is also illustrated as using a releasable connector formed of a shear pin. However, it will be appreciated that other releasable connectors may be utilized. To allow use of a shear pin releasable connector, the lower end of the rod 42 again includes a first shear pin aperture 44. A length of threads (not shown) are formed onto the rod 42 below the shear pin aperture 44 to allow loading/compressing the resilient element using a threaded nut. However, this is not a requirement. The lower end of the rod member may also include a cotter pin aperture (not shown). The bottom end of the fishing neck defines an annular compression flange 27 at the connection point between the fishing neck 38 and the rod 42.

An annular spacer ring 46 is inserted on the rod 42 of the stem 40 such that an upper surface of the ring 46 abuts the annular compression flange 27. The lower surface of the spacer ring 46 abuts against the upper surface of a single resilient element 32, which is inserted over the rod 42 below the spacer ring 46. Below the first resilient element 32 is a spacer sleeve 34. As with the prior embodiment, a releasable connector assembly 50 is disposed on the stem. However, in this embodiment the releasable connector assembly abuts against the spacer sleeve 34. The remainder of the releasable connector assembly 50 of the single resilient element isolation tool 130 is identical to the embodiment of FIGS. 4A-5C.

FIGS. 6C-6F illustrate placement of the isolation tool 130 within a mandrel (not shown). As shown in FIG. 6A, when the isolation tool is initially placed in the mandrel, the resilient element 32 is relaxed. At this time, the threaded nut 66 may be threaded onto the threads to compress the lower sleeve assembly 50 against the resilient elements 32. See FIG. 6D. As the retention nut 66 advances along the threads, it contacts the lower end of the releasable connector assembly 50 and compresses the resilient element 32, which expands outward to contact the interior of the mandrel and inwards to contact the rod 42. In the illustrated embodiment, the threaded nut 66 may be threaded until the second shear pin aperture of the releasable connector assembly 50 is aligned with shear pin aperture of the rod member 42. At this time, a shear pin may be inserted through the aligned shear pin apertures. See FIG. 6D. The shear pin 70 then maintains the compression of the resilient element 32. The threaded nut 66 is then backed off of the lower end of the lower sleeve assembly 50. See FIG. 6E. When the fishing neck 38 is engaged and an axial force is applied to the stem and rod member 42, the rod member 42 moves relative to the releasable connector releasing the connector (e.g., shearing the pin 70) allowing the resilient element 32 to relax. See FIG. 6F. The tool may then be removed from the mandrel.

While the expansion of the resilient element(s) 32 within the interior of the mandrel 20 provides a retention force for maintaining the isolation tool 30 within the mandrel, the retention force provided by such compressive expansion of the resilient element(s) may not be sufficient in all instances. Accordingly, the present embodiments of the tool utilizes the releasable connector assembly 50 to provide a mechanical engagement with the bottom edge of the mandrel 20. More particularly the outer sleeve 54 of the lower sleeve assembly 50 includes a collapsible colleted end that may, upon initial insertion of the tool, prevent the tool from passing through the mandrel. Once the tool is ready for removal from the mandrel, the colleted end and maybe collapsed in conjunction with releasing the releasable connector to allow the tool to pass through the internal bore of the mandrel and production tubing.

Figure 7A:
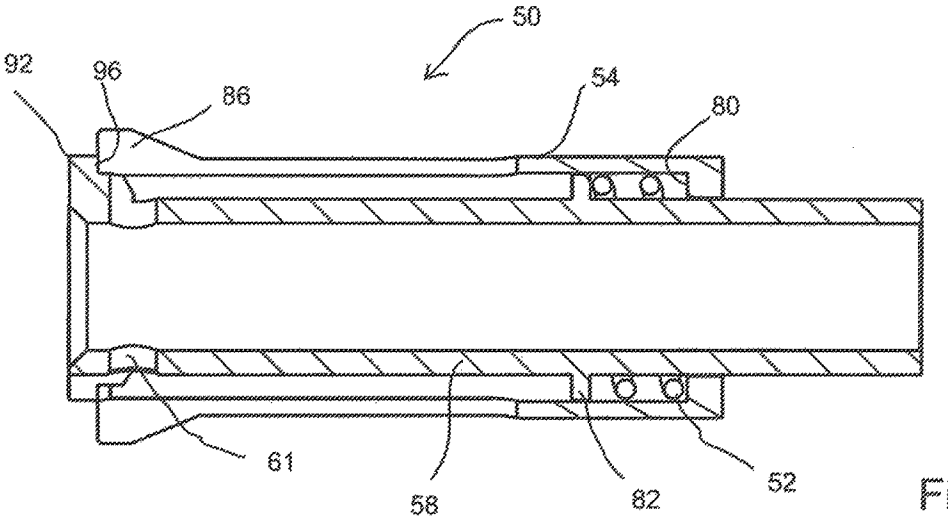
FIGS. 7A and 7B illustrate cross-sectional views the inner and outer sleeves of a lower sleeve assembly of the isolation tool.
Figure 7B:
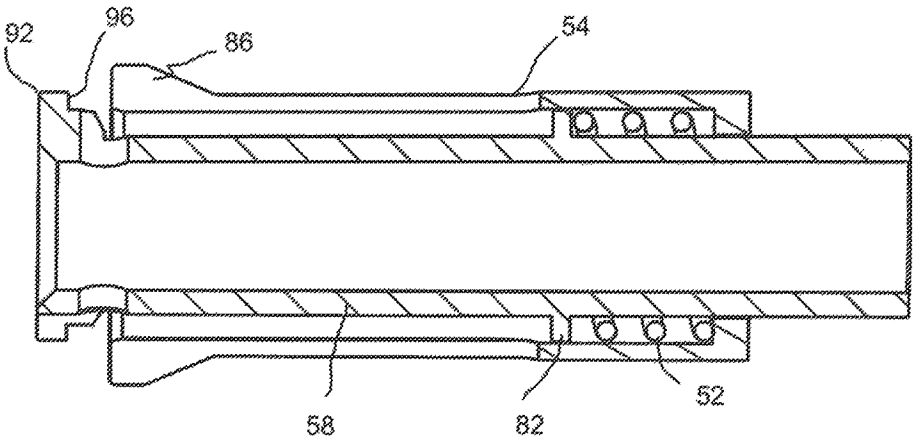

FIGS. 7A and 7B illustrate the releasable connector assembly 50 with the inner sleeve 58 received within the outer sleeve 54. As shown, the outer sleeve has a hollow interior that is sized to receive the inner sleeve 58 and includes an interior annular landing 80 on its upper end. In the present embodiment, the annular landing 80 has a diameter that allows the upper/top end of the inner sleeve 58 to pass/slide through the outer sleeve 54. The top end of the inner sleeve may be received within a central bore of the adjacent spacer ring (not shown). Disposed along the length of the inner sleeve 58 is an annular flange 82. This annular flange 82 has a diameter that corresponds to the inner diameter of the outer sleeve 54. Also disposed along the length of the inner sleeve, in the present embedment, is the second shear pin aperture 61. When assembled, a coil spring 52 is disposed between the outside surface of the inner sleeve 58 and the inside surface of the outer sleeve 54 between the interior annular landing 80 and the annular flange 82. The spring 52 provides a biasing force between the inner sleeve 58 and the outer sleeve 54.

Figure 8B:
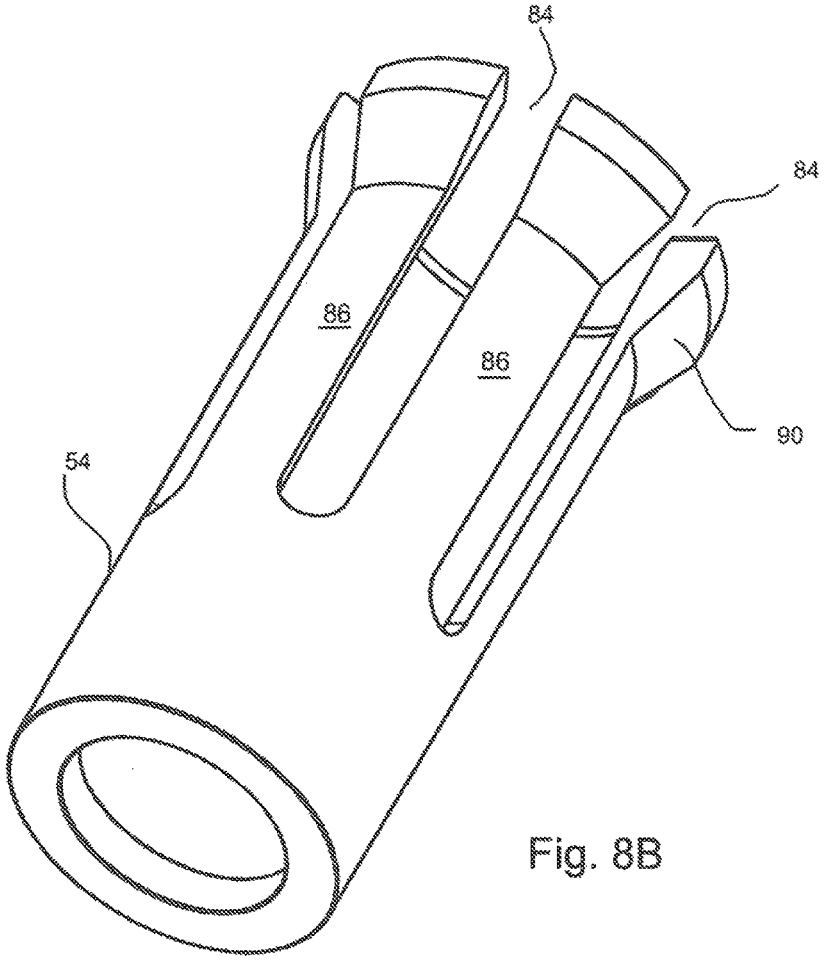
FIGS. 8A and 8B illustrate perspective and side views of an outer sleeve of the lower sleeve assembly.
Figure 8A:
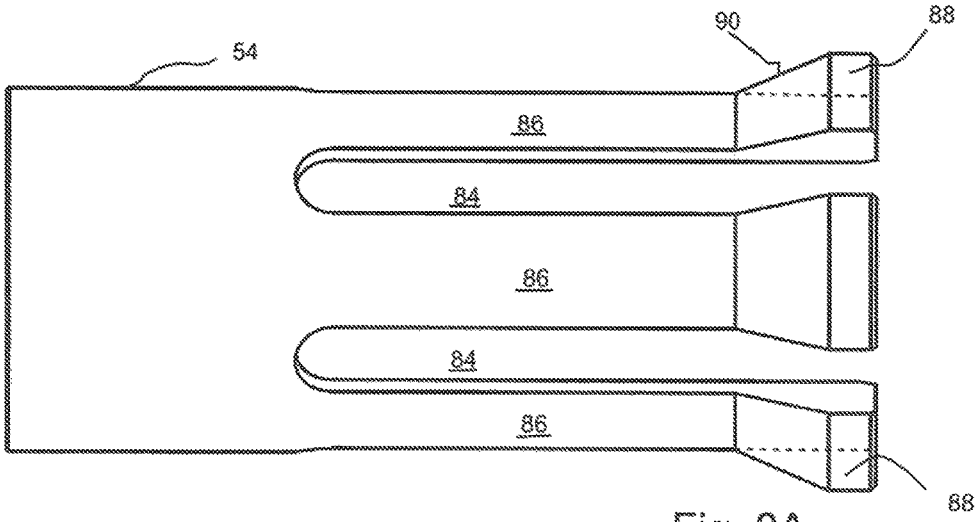

As best shown in FIGS. 8A and 8B, the outer sleeve 54 includes a plurality of axial slits 84 extending from its lower end through a portion of its body. These axial slits 84 define a plurality of cantilevered members 86. These cantilevered members 86 collectively define a collet end or catch end of the outer sleeve. As shown, at the lower outside tips of the cantilevered member 86 have a diameter that is greater than the diameter of the remainder of the sleeve 54, which is sized for receipt within and passage through the interior bore of a mandrel and production tubing. In contrast, the collet end diameter is greater than the interior diameter of the mandrel 20 and production tubing. Stated otherwise, each cantilevered member 86 includes a dog or catch 88 that is utilized to provide a physical obstruction to movement of the tool 30.

Figure 8C:
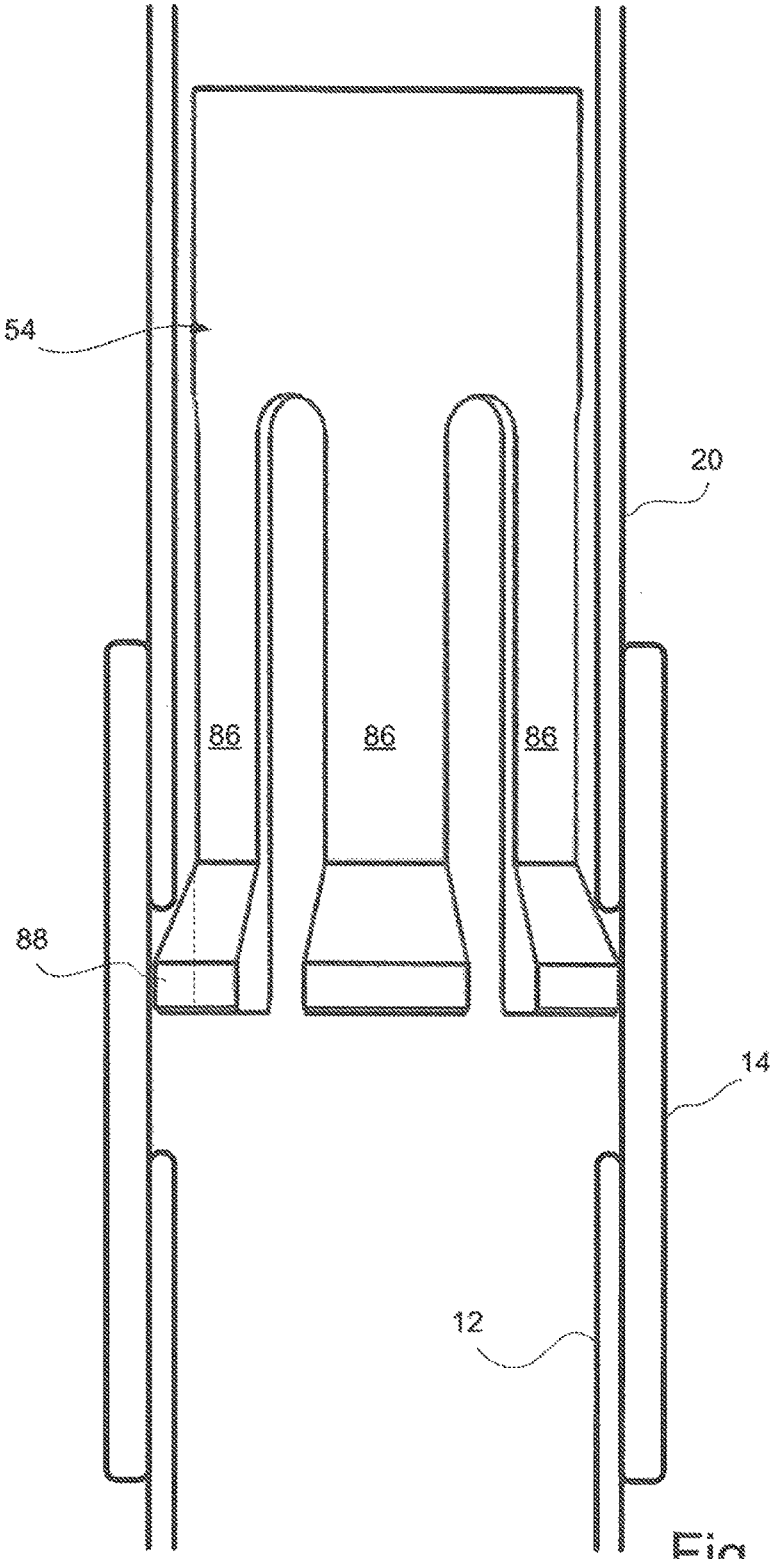
FIG. 8C illustrates the lower sleeve assembly disposed within a mandrel and production tubing.

The catches 88 on the outward surfaces of the cantilevered members 86 (i.e., external catches) affix the tool 30 relative to the mandrel and an adjacent production tubing 12. See FIGS. 4B and 8C. As shown, the mandrel 20 is connected to an adjacent production tubing 12 via a collar 14. In such an arrangement, the facing ends of the mandrel 20 and production tubing 12 are spaced and the collar 14 extends over the outside surfaces of the mandrel and tubing. This leaves a gap between the production tubing and mandrel. When the tool 30 is inserted into the end of the mandrel 20, the increased diameter catches 88 of the outer sleeve 54 abut against a bottom end of the mandrel 20. Prior to deflection of the cantilevered members of the outer sleeve 54, the isolation tool is prevented from passing through the mandrel 20.

As each of the catches 88 is on the free end of a cantilevered member 86, the catches can deflect inward. This is facilitated by angled forward surfaces 90 of each catch 88. See FIGS. 8A and 8B. Thus, when the tool is pulled upward, the cantilevered members deflect inward allowing the tool to move through the internal bore of the mandrel and production tubing. However, it is desirable that the catches not deflect inward until it is desired to remove the tool. The inner sleeve 58 is designed to prevent inward deflection of the cantilevered members 86 until after the releasable connector is release and a user is attempting to remove the tool.

Figure 9:
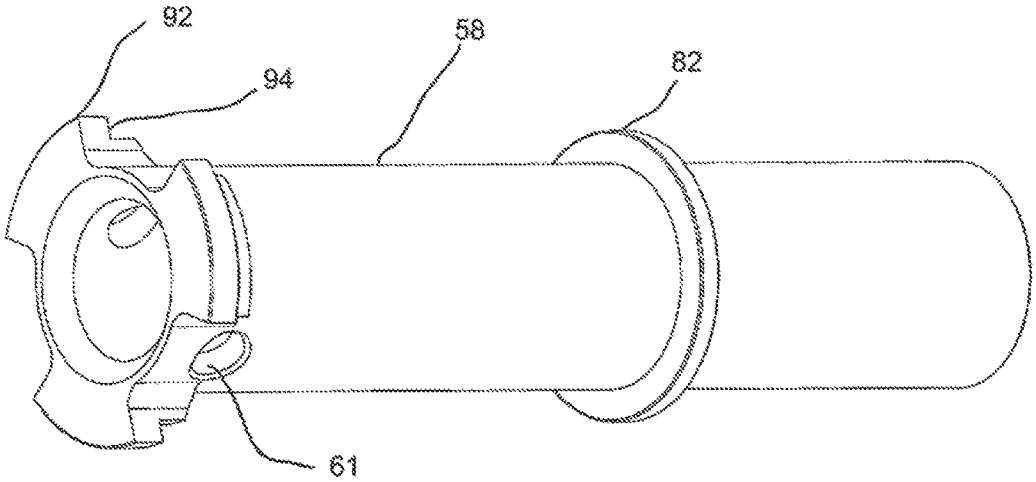
FIG. 9 illustrates a perspective view of an inner sleeve of the lower sleeve assembly.

As shown in FIGS. 7A, 7B and 9, the lower end of the inner sleeve 58 includes a stepped collar 92 having an inner collar 94 that is sized for disposition beneath the tips of the cantilevered members of the outer sleeve 54. That is, the outside diameter of the inner collar 94 (or outside radius measured from a centerline axis) is substantially the same as the inside diameter of the outer sleeve 54. Thus, when the inner collar 94 of the inner sleeve 58 is disposed beneath the cantilevered members of the outer sleeve 54, the cantilevered members cannot deflect inward. See FIG. 7A.

To insert the inner collar 94 within the inside diameter of the lower end of the outer sleeve, the expansive force of the spring 52 must be overcome. In this regard, when the threaded nut 66 or other compression means compresses the resilient element(s), the spring 52 is compressed and the inner collar 94 is disposed within the interior of the outer sleeve 54 until the outer collar 96 contacts the end surface of the outer sleeve 54. Continued compression of the resilient elements(s) allows for connecting the releasable connector (e.g., for aligning the shear pin apertures). In the present embodiment, a shear pin may then be inserted into the aligned shear pin apertures of the inner sleeve and stem. To access these shear pin apertures, the shear pin may be inserted between the cantilevered members of the outer sleeve. In any case, when the releasable connector is connected to the stem, the releasable connector maintains the inner collar 94 in position beneath the cantilevered members preventing their deflection inward. Stated otherwise, the spring 54 cannot expand and move the inner collar 94 from beneath the cantilevered members 86 until the releasable connector disconnects. Thus, the external catches 88 remain of a diameter that prevents passage of the tool 30 through the internal bore of the mandrel or production tubing prior to shearing the shear pin. See FIG. 8C.

Figure 10:
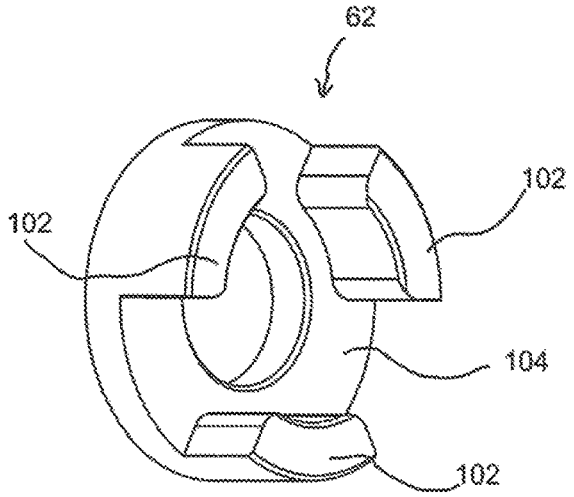
FIG. 10 illustrates a perspective view of a standoff element.

When the releasable connector releases (e.g., when the shear pin shears) the threaded nut 66 or other retention element is drawn toward the bottom end of the lower sleeve assembly 50. Without a standoff, upon applying an upward force to the stem 40, the retention element (e.g., nut 66) would be drawn against the bottom end of the inner sleeve 58 and would prevent the spring 52 from displacing the inner collar 94 from beneath the cantilevered members of the outer sleeve 54, which would prevent inward deflection of the cantilevered members. Accordingly, the tools incorporate a standoff 62 as illustrated in FIGS. 5A, 6B and 10. As shown, the standoff 62 has a generally hollow upper end and a generally planar lower end (i.e., about its central bore).

In the present embodiment, the standoff 62 is a tri-legged standoff configured for use with the tri-lobed inner sleeve member illustrated in FIG. 9. The use of the tri-legged/lobed configuration is a currently preferred embodiment. However, it will be appreciated that a hollow standoff with a continuous annular wall may be utilized with appropriately configured inner and outer sleeve members and variations to the standoff configuration are considered within the scope of the presented inventions.

The standoff has upper support surfaces or legs 102 that are adapted to contact the lower end of the outer sleeve member 54. When the tool is assembled, these legs contact the same surface of the outer sleeve member as is contacted by the outer collar 96 of the inner sleeve member 58. The legs extend to a base 104, the planar rearward surface of which provides an abutment that limits the movement of the retention element/nut 66 when the releasable connector releases. The length and spacing of the legs permits the inner collar 58 a limited amount of movement upon release. Specifically, the height of the legs permits the spring 52 to expand and displace the inner collar 94 from beneath the cantilevered members. Once so displaced, the cantilevered members may be displaced inward allowing for removal of the tool.

In operation, the standoff 62 is inserted over the rod member 42 after the resilient element(s) have been compressed and the releasable connector is connected to the rod. In the present embedment, the standoff is inserted over/onto the rod 42 after retention nut 66 has been advanced and the shear pin is inserted into the shear pin apertures. At such time, the retention nut 66 is removed from the rod 42, the standoff 62 is slid onto the rod member 42, the spring 64 is slid onto the rod 42 and the retention nut 66 is again threaded part way onto the rod 42. The spring 64 applies an expansive force between the retention nut 66 and the standoff 62 that maintains the standoff in proper orientation.

As noted above, the second embodiment of the isolation tool incorporates pressure/fluid equalization assembly. Typically, the isolation tool is utilized to fluidly isolate first and second sections of production tubing. However, when it is time to remove the tool from the tubing/mandrel, pressure differentials across the tool can, in some instances, hinder removal. Accordingly, incorporation of a fluid equalization assembly allows for fluid to flow across the tool prior to removal. The fluid equalization assembly generally includes a poppet valve that can be selectively moved from a closed position to an open position to permit pressure equalization across the tool.

The fluid equalization assembly is variously illustrated in FIGS. 6A-6F, 11A and 11B. Though illustrated in the second embodiment of the isolation tool, it will be appreciated that the fluid equalization assembly may be incorporated into the first embodiment as well. The fluid equalization assembly provides a fluid flow path through the stem 40 of the isolation tool. More specifically, a flow path extends between one or more inlet/outlet port(s) or bleed port(s) 122 in the upper portion of the stem 40 (e.g., fishing neck 38), extending through an internal bore 106 within the rod 42 and another inlet/outlet port(s) bleed port(s) 124 in an side surface of the tool at a location below the resilient member(s) 32. In the illustrated embodiment, the second bleed port exits through an external sidewall of the stem 42 and extends into and through the spacer 34. This regard, the spacer may have a recessed internal surface and location proximate to the bleed port in the stem 42. In any case, the flow path defined by the bleed ports and internal bore allows fluid flow across the resilient member 32.

Figure 11B:
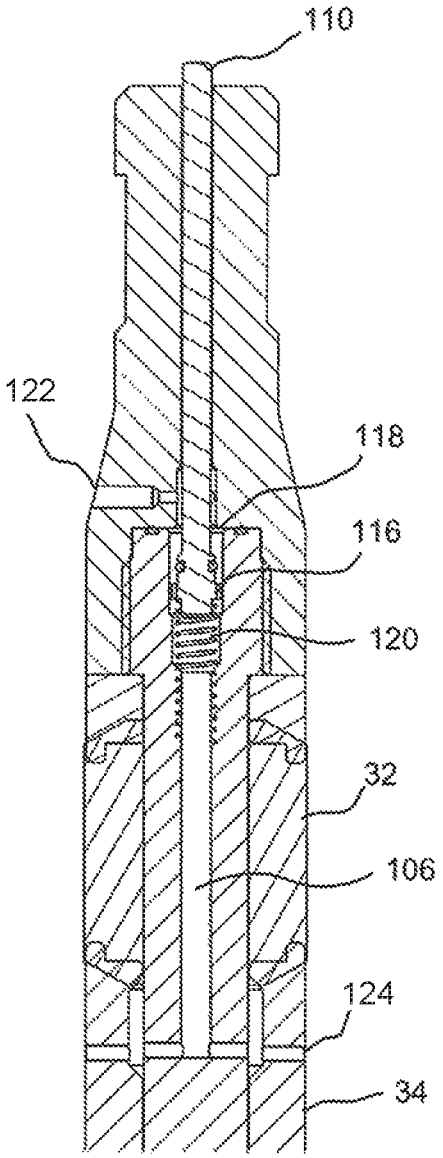
FIG. 11B illustrates the fluid equalization assembly in an open position.
Figure 11A:
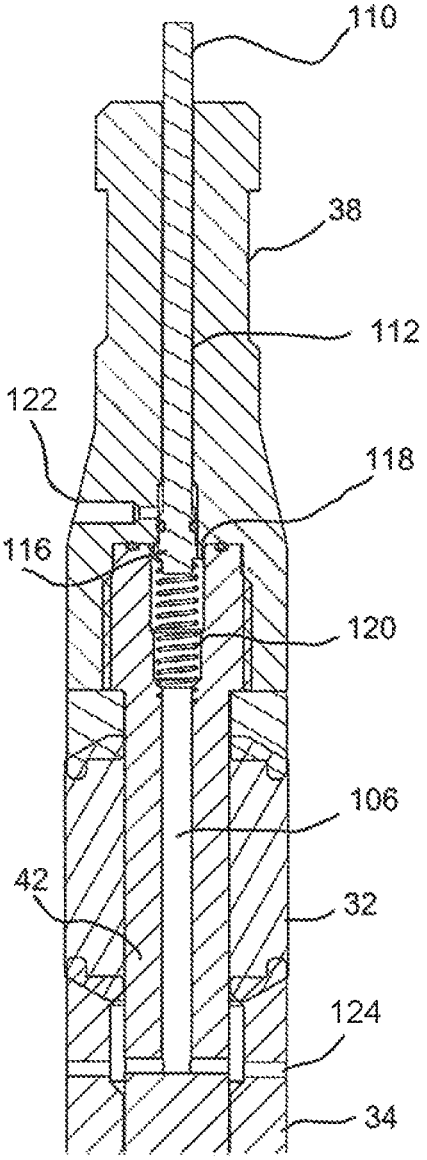
FIG. 11A illustrates a fluid equalization assembly in a closed position.

Typically, flow through the flow path is only desirable during removal of the tool. Accordingly, the flow path includes a spring-loaded poppet valve assembly that closes the flow path until the poppet valves actuated or opened by user. As best shown in FIGS. 6B, 11A and 11B, the poppet valve assembly includes a poppet rod 110 which extends through and above a top end of the tool. More specifically, the poppet rod 110 extends through an upper bore 112 that extends through the fishing neck and out the end of the tool. As shown, the first bleed port 122 extends into the upper bore 112. Attached to a lower end of the poppet rod 112 is a plunger 116. This plunger extends into the cavity within the stem 42. Also disposed within this cavity is a biasing element or spring 120. The spring urges the plunger 116 against a valve seat 118 defined on the top end of the cavity. This is illustrated in FIG. 11A. In this closed configuration, the plunger is disposed against the valve seat closing the flow path between the bleed ports 122 and 124. Various O-rings or other seals may be utilized to seal the plunger in the closed position. In any case, fluid is prevented from flowing through the flow path when the plunger is in the closed position.

When it is desirable to open the poppet valve assembly, an implement or tool is lowered into the interior of the production tubing (not shown) and depress the upper end of the poppet rod 110. See FIG. 11B. Such depression of the rod moves the plunger 116 downward compressing the spring 120. Further, the plunger moves away from the valve seat 118 opening a flow path between the ports 122 and 124. Accordingly, fluid pressure may equalize across the tool. In use, it may be desirable to wait a period of time while fluid pressures equalize. Once fluid pressures of equalize, the tool utilized to depress the poppet rod 110 or another tool may be utilized to engage the fishing neck 38 and remove the tool from the production tubing/wellbore.

Typically, the tool and the mandrel 20 are supplied to a user as a preassembled set. That is, specific valves are inserted into mandrels and tested based on their intended location within the well. Further, the preassembly of the tool and mandrel permits pressure testing to assure that the resilient elements have isolated the valve port(s). Accordingly, it is believed that aspects of the tool are novel alone as well as in combination with a mandrel.

The foregoing description has been presented for purposes of illustration and description. Furthermore, the description is not intended to limit the inventions and/or aspects of the inventions to the forms disclosed herein. Consequently, variations and modifications commensurate with the above teachings, and skill and knowledge of the relevant art, are within the scope of the presented inventions. The embodiments described hereinabove are further intended to explain best modes known of practicing the inventions and to enable others skilled in the art to utilize the inventions in such, or other embodiments and with various modifications required by the particular application(s) or use(s) of the presented inventions. It is intended that the appended claims be construed to include alternative embodiments to the extent permitted by the prior art.

What is claimed is:

1. An isolation tool for removable disposition within a hollow interior of a gas lift mandrel for at least partially isolating a valve port though a sidewall of the gas lift mandrel, comprising:

a stem having:

an elongated rod;

an annular flange on an upper end of said rod having a cross-dimension that is greater than a corresponding cross-dimension of said rod;

at least one annular resilient element disposed over said rod beneath said annular flange; and a releasable connector assembly including at least one sleeve disposed over said rod below said annular resilient element, said releasable connector assembly configured to:

attach to said rod in a first configuration wherein said at least one sleeve compresses said at least one annular resilient element, wherein a periphery of said annular resilient element expands outward;

release from said rod in a second configuration in response to an axial force being applied to said rod, wherein compression of said annular resilient element is released.

2. The device of claim 1, wherein:

said stem further comprises a first connector disposed on a lower portion of said rod below said annular resilient element; and said releasable connector assembly comprises a second connector along a length of said at least one sleeve, said second connector adapted for selective connection with said first connector.

3. The device of claim 2, wherein upon advancing said sleeve along said rod to align and connect said second connector with said first connector, said at least one sleeve compresses said at least one annular resilient element.

4. The device of claim 3, wherein said first and second connectors comprise: a first shear pin aperture extending through said lower portion of said rod, wherein said first shear pin aperture extends transverse to a long axis of said rod; and a second shear pin aperture extending through a portion of said at least one sleeve of said releasable connector assembly, wherein upon said first and second shear pin apertures being aligned, said at least one annular resilient element is compressed.

5. The device of claim 4, further comprising:

a shear pin disposable within said first and second shear pin apertures when said apertures are aligned, wherein when disposed in said shear pin aperture said shear pin maintains a fixed positional relationship of said at least one sleeve and said rod.

6. The device of claim 5, wherein said shear pin has a hardness that is less than a hardness of said portion of said lower sleeve assembly and said rod, wherein said shear pin shears upon movement of said rod relative to said at least one sleeve.

7. The device of claim 1, further comprising:

a retention element engaging said rod below said releasable connector sleeve assembly, wherein said retention element has an outside cross-dimension greater than an inside cross-dimension of said releasable connector assembly.

8. The device of claim 7, wherein a lower end of said rod is a threaded rod portion and said retention element is a mating threaded element.

9. The device of claim 1, wherein said at least one sleeve further comprises:

an outer sleeve and an inner sleeve, wherein said inner sleeve is at least partially received in said outer sleeve.

10. The device of claim 9, wherein a bias force element is disposed between said first and second sleeves, wherein said bias force element is compressed when said releasable connector is attached to said rod.

11. The device of claim 10, wherein said outer sleeve further comprises:

a plurality of slits each extending from a bottom end of said outer sleeve through a portion of a length of said outer sleeve, wherein said axial slits define a plurality of cantilevered members.

12. The device of claim 11, wherein an upper end of said outer sleeve has a first outside diameter and said bottom end of said outer sleeve as defined by said cantilevered members has a second outside diameter that is greater than said first diameter.

13. The device of claim 12, wherein said first outside diameter is less than an inside diameter of a well tubing in which said isolation tool is inserted and said second outside diameter is greater than the inside diameter of the well tubing.

14. The device of claim 13, wherein an upper portion of said inner sleeve has an outside diameter that is less than an inside diameter of said outer sleeve and a bottom end portion of said inner sleeve has an outside diameter that is substantially equal to the inside diameter of said outer sleeve.

15. The device of claim 14, wherein, when said bottom end portion of said inner sleeve is disposed within said outer sleeve, said bottom end portion prevents said cantilevered members from deflecting inward.

16. The device of claim 1, wherein said at least one annular resilient element comprises:

first and seconds annular resilient elements separated by a non-resilient sleeve member.

17. The device of claim 1, wherein said stem further comprises:

an upper end including a fishing neck.

18. The device of claim 1, wherein said stem further comprises:

a fluid passage extending through at least a portion of said stem, said fluid passage having a first port disposed above said annular flange and a second port disposed below said at least one resilient element; and a valve disposed within said fluid passage, said valve moveable between an open position and a closed position for selectively allowing fluid flow through said fluid passage.

19. The device of claim 18, further comprising:

an actuator rod disposed though a bore in a top end of said stem and connecting to said valve, wherein upon depressing a top end of said actuator rod toward said top end of said stem, said valve moves to said open position to allow fluid flow through said fluid passage.

* * * * *